US008709985B2

(12) United States Patent
Devlin et al.

(10) Patent No.: US 8,709,985 B2
(45) Date of Patent: Apr. 29, 2014

(54) LUBRICANT COMPOSITION

(75) Inventors: Mark T. Devlin, Richmond, VA (US); John T. Loper, Richmond, VA (US); Roger M. Sheets, Glen Allen, VA (US); Todd M. Dvorak, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 647 days.

(21) Appl. No.: 11/561,062

(22) Filed: Nov. 17, 2006

(65) Prior Publication Data

US 2008/0119376 A1 May 22, 2008

(51) Int. Cl.
*C10M 169/04* (2006.01)

(52) U.S. Cl.
USPC ..... 508/110

(58) Field of Classification Search
USPC ..... 508/110; 123/25, 257
See application file for complete search history.

(56) References Cited

U.S. PATENT DOCUMENTS

| | | | | |
|---|---|---|---|---|
| 3,232,863 | A * | 2/1966 | Watson et al. | 208/36 |
| 4,801,733 | A * | 1/1989 | Wuest et al. | 560/56 |
| 5,015,404 | A * | 5/1991 | Kubo et al. | 508/132 |
| 6,323,162 | B1 | 11/2001 | Yasunori et al. | |
| 2003/0051988 | A1 * | 3/2003 | Gunnerman et al. | 204/157.15 |

FOREIGN PATENT DOCUMENTS

WO 2006/094264 9/2006

OTHER PUBLICATIONS

M.T. Devlin, et al., "Effect of Detailed Base Oil Structure on Oxidation Performance of Automatic Transmission Fluids," Proceedings of WTC 2005, Sep. 12-16, 2005, pp. 1-2.

* cited by examiner

*Primary Examiner* — James Goloboy
*Assistant Examiner* — Latosha Hines
(74) *Attorney, Agent, or Firm* — Luedeka Neely Group, P.C.

(57) ABSTRACT

There is disclosed a lubricant composition comprising a base oil comprising a reduced total amount of cyclobenzene as compared to another base oil. Methods of using the lubricant composition for preventing and/or reducing the deposit formation in an engine are also disclosed.

8 Claims, No Drawings

LUBRICANT COMPOSITION

FIELD OF THE DISCLOSURE

The present disclosure relates to lubricant compositions comprising a base oil comprising a reduced total amount of cyclobenzene as compared to another oil.

BACKGROUND OF THE DISCLOSURE

Lubricating oils that are suitable for use in modern engines must meet industry performance specifications. Today's engines are designed to run hotter and harder than in the past. However, an adverse affect of running hotter is that oxidation of the oils increases as the operating temperature of the oil increases. Oxidation of the oils can lead to a viscosity increase in the oil and the formation of high temperature deposits caused by agglomerated oxidation by-products baking onto lubricated surfaces. It is believed that these deposits can negatively affect engine performance by, for example, clogging fuel induction systems. Considerable research has been devoted to additives for controlling (preventing or reducing) deposit formation in internal combustion engines.

However, it is also known that some additives are very expensive. And, the use of additional amounts of an additive to a lubricant composition to reduce deposit formation can be quite costly to the manufacturer.

A major component of a lubricant composition can be the base oil, which is relatively inexpensive. Base oils are known and have been categorized under Groups I-V. The base oils are placed in a given Group based upon their % saturates, % sulfur content, and viscosity index. For example, all Group II base oils have greater than 90% saturates, less than 0.03% sulfur, and a viscosity index ranging from ≥80 to ≤120. However, not all Group II base oils are the same. For example, the proportions of aromatics, paraffinics, and naphthenics can vary substantially in the Group II base oils. It is known that the differences between base oils of a given Group can affect the properties of a lubricant composition comprising such as base oil, such as oxidative stability and deposit formation.

Hence, what is needed is a lubricant composition that is inexpensive and can provide reduced deposit formation.

Accordingly, there is a need for a lubricant composition that can reduce deposit formation as required by the new generation of engines. The present disclosure proposes a lubricant composition that can reduce deposit formation.

SUMMARY

In accordance with the disclosure, there is disclosed a lubricant composition comprising a base oil comprising a reduced total amount of cyclobenzene as compared to another base oil.

In an aspect, there is disclosed a method for preventing and/or reducing the formation of deposits in an engine, comprising providing to the engine a lubricant composition comprising a base oil comprising a reduced total amount of cyclobenzene as compared to another base oil.

There is also disclosed a method of passing a TEOST-MHT test comprising providing to a lubricant designed for engines a lubricant composition comprising a base oil comprising a reduced total amount of cyclobenzene as compared to another base oil.

Further, in an aspect, there is disclosed a method of lubricating at least one moving part with a lubricant composition, the method comprising providing to at least one moving part a lubricant composition comprising a base oil comprising a reduced total amount of cyclobenzene as compared to another base oil.

Additional advantages of the disclosure will be set forth in part in the description which follows or may be learned by practice of the disclosure. The advantages will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

The present disclosure relates to lubricant compositions comprising a base oil comprising a reduced total amount of cyclobenzene as compared to another base oil. The base oil can be any base oil categorized in Groups I-V.

The base oil can be present in the lubricant composition in any desired or effective amount. For example, the base oil can be present in a major amount. A "major amount" is understood to mean greater than or equal to 50% by weight relative to the total weight of the composition. As a further example, the base oil can be present in an amount greater than or equal to 80%, and as an additional example, greater than or equal to 90% by weight relative to the total weight of the composition.

The lubricant compositions disclosed herein can be used to lubricate anything. In an aspect, the lubricant composition can be used to lubricate a machine, such as, an engine, and at least one moving part.

The cyclobenzene in the disclosed lubricant composition can be selected from the group consisting of dicyclobenzene, tricyclobenzene, tetracyclobenzene, and combinations thereof. In an aspect, the base oil can comprise a reduced amount of dicylcobenzene as compared to another base oil. In other embodiments, the base oil can comprise a reduced amount of tricyclobenzene as compared to another base oil. Yet, in some other embodiments, the base oil can comprise a reduced amount of tetracyclobenzene as compared to another base oil.

In an aspect, dicylcobenzene can be present in the base oil in an amount of about 0 to about 2.0 wt. %, for example from about 0.1 wt. % to about 1.8 wt. %, and as a further example from about 0.2 wt. % to about 1.5 wt. % relative to the total weight of the base oil. In another aspect, tricylcobenzene can be present in an amount of about 0 to about 1.5 wt. %, for example from about 0.1 wt. % to about 1.2 wt. %, and as a further example from about 0.15 wt. % to about 0.9 wt. % relative to the total weight of the base oil. In some other aspect, tetracylcobenzene can be present in an amount of about 0 to about 1.0 wt. %, for example from about 0.01 wt. % to about 0.8 wt. %, and as a further example from about 0.02 wt. % to about 0.6 wt. % relative to the total weight of the base oil.

Optionally, additives can be present in the lubricant composition. Non-limiting examples of additives include dispersants, anti-wears, antioxidants, friction modifiers, anti-foamers, diluents, pour-point depressants, viscosity index improvers, corrosion inhibitors, extreme pressure agents, seal well agents, and demulsifiers.

According to various embodiments, there is a method for preventing and/or reducing the formation of deposits in an engine. The method can comprise providing to the engine a lubricant composition comprising a base oil comprising a reduced total amount of cyclobenzene as compared to another base oil.

According to some embodiments, there is a method of lubricating a machine. The method can comprise providing to the machine the lubricant composition comprising a base oil comprising a reduced total amount of cyclobenzene as compared to another base oil. In an aspect, the machine can be selected from the group consisting of an engine, a gear, and a transmission.

In other embodiments, there is a method of passing a TEOST-MHT test. The method can comprise providing to a lubricant designed for engines a lubricant composition comprising a base oil comprising a reduced total amount of cyclobenzene as compared to another base oil.

According to various embodiments, there is a method of lubricating at least one moving part with a lubricant composition. The method can comprise providing to at least one moving part a lubricant composition comprising a base oil comprising a reduced total amount of cyclobenzene as compared to another base oil.

EXAMPLE

TEOST MHT Deposits Versus Base Oil Composition

Four different formulations, A, B, C, and D as described in Table 1, comprising different base oils were subjected to the TEOST MHT test to measure the amount of deposit formation. The TEOST-MHT test is a standard industry test for the evaluation of the oxidation and carbonaceous deposit-forming characteristics of engine oils. The test is designed to simulate high temperature deposit formation in the piston ring belt area of modern engines. In general, the lower the milligrams of deposit, the better the result.

The base oils in Table 1 were analyzed according to the procedure in Analytical Chemistry, 64:2227 (1992) and WTC-III paper 2005-63563, the disclosures of which are hereby incorporated by reference, in order to determine the concentration of di-, tri-, tetra-, and total cyclobenzene in each base oil.

TABLE 1

| Formulation | TEOST MHT Deposit (mg) | Dicyclobenzene wt. % | Tricyclobenzene wt. % | Tetracyclobenzene wt. % | Total Cyclobenzene wt. % |
|---|---|---|---|---|---|
| A | 44.2 | 1.38 | 0.83 | 0.47 | 2.68 |
| B | 43.3 | 1.31 | 0.47 | 0.13 | 1.91 |
| C | 41.9 | 0.93 | 0.29 | 0.08 | 1.30 |
| D | 40.3 | 0.24 | 0.18 | 0.03 | 0.45 |

As can be seen from Table 1, the TEOST MHT deposit amount decreases as the total amount of cyclobenzene in the formulation decreases. Formulation A has the highest amount of total cyclobenzene (2.68 wt. %) and also has the highest amount of deposit, 44.2 mg. Formulation B has a higher amount of total cyclobenzene (1.91 wt. %) as compared to formulation C (1.3 wt. %) and also has a higher amount of deposit (43.3 mg as compared to 41.9 mg). Formulation D has the least amount of total cyclobenzene (0.45 wt. %) as compared to formulations A, B, and C and also has the least amount of deposit (40.3 mg). Because formulations A, B, C, and D were formulated with the same additives but different base oils comprising different total amounts of cyclobenzene, the reduced deposit formation in the TEOST MHT test can be attributed to the reduced total amount of cyclobenzene in the formulations.

At numerous places throughout this specification, reference has been made to a number of U.S. patents, published foreign patent applications and published technical papers. All such cited documents are expressly incorporated in full into this disclosure as if fully set forth herein.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

It is noted that, as used in this specification and the appended claims, the singular forms "a," "an," and "the," include plural referents unless expressly and unequivocally limited to one referent. Thus, for example, reference to "an antioxidant" includes one or more different antioxidants. As used herein, the term "include" and its grammatical variants are intended to be non-limiting, such that recitation of items in a list is not to the exclusion of other like items that can be substituted or added to the listed items.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

Applicant does not intend to dedicate any disclosed embodiments to the public, and to the extent any disclosed modifications or alterations may not literally fall within the scope of the claims, they are considered to be part of the invention under the doctrine of equivalents.

What is claimed is:

1. A lubricant composition comprising: a base oil comprising a reduced total amount of cyclobenzene as compared to another base oil to provide a reduced deposit formation in a TEOST MHT test, wherein the total amount of cyclobenzene includes the sum of dicyclobenzene, tricyclobenzene, tetracyclobenzene, and combinations thereof, wherein the dicyclobenzene is present in an amount of about 0.1 to about 2.0 wt. %, the tricyclobenzene is present in an amount of about 0.1 to about 1.5 wt. %, the tetracyclobenzene is present in an amount of about 0.01 to about 1.0 wt. %, and the total amount of cyclobenzene ranges from about 0.21 to about 4.5 wt. % relative to the total weight of the base oil.

2. The lubricant composition of claim 1, further comprising at least one additive selected from the group consisting of dispersants, anti-wears, antioxidants, friction modifiers, anti-foamers, diluents, pour-point depressants, viscosity index improvers, corrosion inhibitors, extreme pressure agents, seal swell agents, and demulsifiers.

3. An engine, transmission, or gear set lubricated with a lubricant composition according to claim 1.

4. A method of lubricating a machine comprising providing to the machine the lubricant composition of claim 1.

5. The method of claim 4, wherein the machine is selected from the group consisting of an engine, a gear, and a transmission.

6. A method for preventing and/or reducing the formation of deposits in an engine, comprising providing to the engine a lubricant composition comprising a base oil comprising a reduced total amount of cyclobenzene as compared to another base oil wherein the total amount of cyclobenzene includes the sum of dicyclobenzene, tricyclobenzene, tetracyclobenzene, and combinations thereof;

wherein the dicyclobenzene is present in an amount of about 0.1 to about 2.0 wt. %, the tricyclobenzene is present in an amount of about 0.1 to about 1.5 wt. %, the tetracyclobenzene is present in an amount of about 0.01 to about 1.0 wt. %, and the total amount of cyclobenzene ranges from about 0.21 to about 4.5 wt. %, relative to the total weight of the base oil.

7. A method of passing a TEOST-MHT test comprising: providing to a lubricant designed for engines a lubricant composition comprising a base oil comprising a reduced total amount of cyclobenzene as compared to another base oil wherein the total amount of cyclobenzene includes the sum of dicyclobenzene, tricyclobenzene, tetracyclobenzene, and combinations thereof;

wherein the dicyclobenzene is present in an amount of about 0.1 to about 2.0 wt. %, the tricyclobenzene is present in an amount of about 0.1 to about 1.5 wt. %, the tetracyclobenzene is present in an amount of about 0.01 to about 1.0 wt. %, and the total amount of cyclobenzene ranges from about 0.21 to about 4.5 wt. %, relative to the total weight of the base oil.

8. A method of lubricating at least one moving part with a lubricant composition, the method comprising providing to at least one moving part a lubricant composition comprising a base oil comprising a reduced total amount of cyclobenzene as compared to another base oil wherein the total amount of cyclobenzene includes the sum of dicyclobenzene, tricyclobenzene, tetracyclobenzene, and combinations thereof;

wherein the dicyclobenzene is present in an amount of about 0.1 to about 2.0 wt. %, the tricyclobenzene is present in an amount of about 0.1 to about 1.5 wt. %, the tetracyclobenzene is present in an amount of about 0.01 to about 1.0 wt. %, and the total amount of cyclobenzene ranges from about 0.21 to about 4.5 wt. %, relative to the total weight of the base oil.

* * * * *